US005289767A

United States Patent [19]

Montalto et al.

[11] Patent Number: 5,289,767

[45] Date of Patent: Mar. 1, 1994

[54] METHOD AND APPARATUS FOR GUIDING AN ELONGATED GENERALLY CYLINDRICAL MEMBER PAST A NON-CONTACT PRINTING STATION

[75] Inventors: Joseph S. Montalto, Whitewater, Wis.; John R. Forster; Randy A. Hoch, both of Spring Grove, Ill.; Jack D. Cornes, Twin Lakes, Wis.

[73] Assignee: VideoJet Systems International, Inc., Wood Dale, Ill.

[21] Appl. No.: 933,288

[22] Filed: Aug. 21, 1992

[51] Int. Cl.[5] ..... B41F 17/00

[52] U.S. Cl. ..... 101/35; 101/420

[58] Field of Search ..... 101/4, 35, 37, 44, 416.1, 101/420; 118/630, DIG. 1, DIG. 21; 226/148, 156

[56] References Cited

U.S. PATENT DOCUMENTS

| | | | |
|---|---|---|---|
| 2,920,384 | 1/1960 | Fasoli et al. | 101/37 |
| 3,635,153 | 1/1972 | Gartside | 101/37 |
| 3,711,757 | 1/1973 | Reforzo | 101/37 |
| 4,029,006 | 6/1977 | Mercer | 101/35 |
| 4,089,451 | 5/1978 | Zlaikha | 226/148 |
| 4,445,668 | 5/1984 | Sauber | 226/181 |
| 4,705,415 | 11/1987 | Grombchevsky et al. | 101/35 |
| 5,142,298 | 8/1992 | Hoffmann et al. | 346/1.1 |

OTHER PUBLICATIONS

Four photographs of prior wire marking apparatus.

*Primary Examiner*—Edgar S. Burr
*Assistant Examiner*—Ren Yan
*Attorney, Agent, or Firm*—Welsh & Katz, Ltd.

[57] ABSTRACT

Mechanism for guiding a continuous length elongated member, such as an insulated wire, past a non-contact print head includes pairs of guide rollers operative to guide the elongated member in a generally constant orientation past the print head without smudging indicia printed at periodic positions along the member. In one embodiment, pairs of guide rollers are disposed upstream and downstream from the print head and include one-way bearings to prevent rearward movement of the elongated member without contacting the printed indicia. In another embodiment, a pair of cylindrical rollers are disposed downstream of the print head and urge the elongated member against a reference plate so as to maintain the member in desired orientation as it passes the print head without smudging the printed indicia.

27 Claims, 3 Drawing Sheets

METHOD AND APPARATUS FOR GUIDING AN ELONGATED GENERALLY CYLINDRICAL MEMBER PAST A NON-CONTACT PRINTING STATION

BACKGROUND OF THE INVENTION

The present invention relates generally to apparatus for non-contact printing of indicia on a continuous length elongated member, such as an insulated wire and the like, and more particularly to a new and improved method and apparatus for guiding such an elongated member longitudinally past an ink jet printing station to enable high quality printed images to be placed on the member.

It is a common practice in identifying insulated wire and the like to apply identifying indicia on the exterior surface of the outer insulation layer or sheath. The identifying indicia may comprise relatively simple coding such as a particular wire gauge or size, for example, A.W.G. 16. In many applications, however, multiple insulated electrical wires are grouped to form a wire harness which may be installed in a circuit employing a number of multiple-wire harnesses interconnecting plugs, connectors and other terminal components. In such applications it is particularly important to be able to identify and distinguish each wire in the same or similar wire harnesses. To meet this need, multiple character alpha-numeric codes are applied to the individual insulated wire strands, or to the exterior surface of a multi-conductor longitudinally twisted wire group. Prior practices have included cold printing and hot stamping the alpha-numeric identification codes onto the insulating layers or sheaths of the electrical conductors, and securing printed tapes or sleeve tags on the wires at spaced intervals. These techniques have significant disadvantages such as requiring intermittent movement of the wire so that it is stationary during printing or application of identifying tags. In addition, the prior techniques are relatively slow and in the case of direct printing onto the insulated wires, often result is smudged or blurred identifying indicia. Moreover, it has been found that these prior techniques do not work satisfactorily with twisted, straight-stranded or braided wires because of their irregular exterior surfaces.

In an attempt to overcome the aforedescribed problems encountered in applying identifying indicia to insulated conductor wires and the like having three dimensional outer surfaces, ink jet printing techniques have been employed to apply alpha-numeric characters to electrical wires and other continuous elongated flexible members. See, for example, U.S. Pat. No. 4,029,006. A significant drawback in the methodology disclosed in U.S. Pat. No. 4,029,006 is that the elongated member is guided past an ink jet printing head by tubular guides disposed on the upstream and downstream sides of the printing head. Since the ink jet printing head projects electrostatically charged ink droplets onto the outer surface of the passing elongated conductor wire to form identifying indicia, passage of the imprinted wire through a tubular guide on the downstream side of the print head in a manner to physically guide the wire may result in smudging or blurring of the printed indicia. Further, the elongated wire has a tendency to rotate about its longitudinal axis as it is fed from a wound supply reel or spool, with the result that the printed indicia or characters may not be in proper longitudinal alignment on the outer surface of the wire, thus inhibiting easy reading of the indicia during field installation.

A more recent technique for applying indicia to the outer surface of an elongated generally cylindrical member, such as a continuous length insulated conductor wire, by ink jet printing employs a wire guide mechanism having pairs of rollers upstream and downstream of a ink jet print head. The rollers define nips through which the wire passes to guide the wire past the print head. While this technique provides improved performance over prior wire handling mechanisms utilized with ink jet printing processes, an apparatus or mechanism which enables high quality ink jet printing of indicia onto the three-dimensional external surface of an elongated member, such as an insulated electrical conductor wire, by maintaining the elongated member in a relatively constant rotational orientation as it moves longitudinally past the ink jet print head without smudging or smearing would provide a significant improvement over prior wire handling mechanisms.

SUMMARY OF THE INVENTION

One of the primary objects of the present invention is to provide a new and improved method and apparatus for guiding a continuous generally cylindrical elongated member past a non-contact printing station operative to apply indicia on the external surface of the member.

A more particular object of the present invention is to provide a novel method and apparatus for guiding an elongated member, such as an insulated electrical conductor wire, past an ink jet print head operative to apply indicia to the external surface of the member, the apparatus including guide means on the upstream and downstream sides of the print head to maintain the elongated member in a constant rotational orientation without vertical or back and forth movement as it moves longitudinally past the print head, whereby smearing or smudging of the printed indicia is prevented and longitudinal alignment of printed characters on the elongated member is assured.

A further object of the present invention is to provide a novel wire handling mechanism or apparatus operative to guide an elongated generally cylindrical member longitudinally past a non-contact print station operative to print indicia on the external surface of the member, the apparatus including pairs of guide rollers disposed upstream and downstream of the print station for cooperation with the elongated member to prevent rotational twisting and vertical and longitudinally rearward movement of the member as it passes the print station without smearing or smudging of the printed indicia.

A feature of one embodiment of the wire handling apparatus in accordance with the invention lies in the provision of pairs of guide rollers disposed upstream and downstream of an ink jet print head and wherein the roller pairs have, respectively, vertical and horizontal axes of rotation and define nips through which the elongated members passes, at least one roller of each pair of guide rollers having a unidirectional bearing to prevent rearward longitudinal movement of the elongated member.

A feature of a second embodiment of the wire handling mechanism in accordance with the present invention lies in the provision of a pair of guide rollers downstream from an ink jet print head and defining a nip therebetween through which the wires passes, the rotational axes of the roller pair being parallel and inclined relative to the path of travel of the wire to urge the wire against a reference plate so as to prevent rotation of the wire about its longitudinal axis and prevent smearing of indicia printed on the insulated wire.

A feature of both embodiments of the wire handling mechanism in accordance with the present invention lies in the ability to utilize the mechanism with various wire processing machinery.

Further objects, features and advantages of the present invention, together with the organization and manner of operation thereof, will become apparent from the following detailed description of the invention taken in conjunction with the accompanying drawings wherein like reference numerals designate like elements throughout the several views.

DETAILED DESCRIPTION

Figure 1:
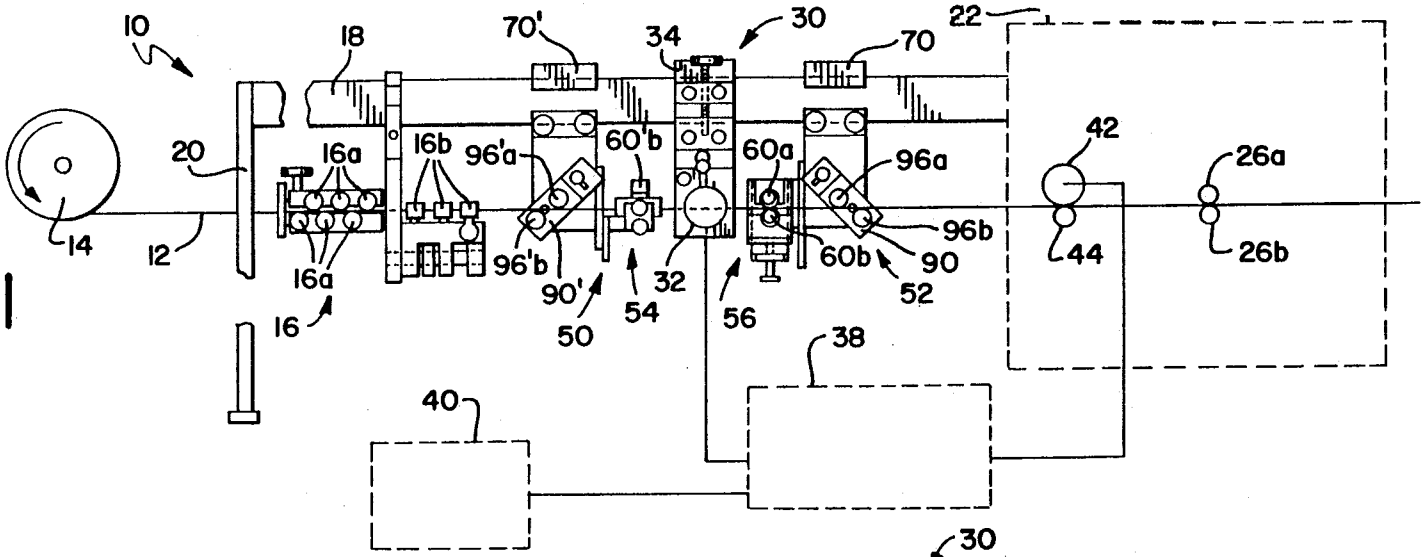
FIG. 1 is a schematic diagram of a system for non-contact printing of indicia on a continuous length elongated member in accordance with one embodiment of the present invention.
Figure 2:
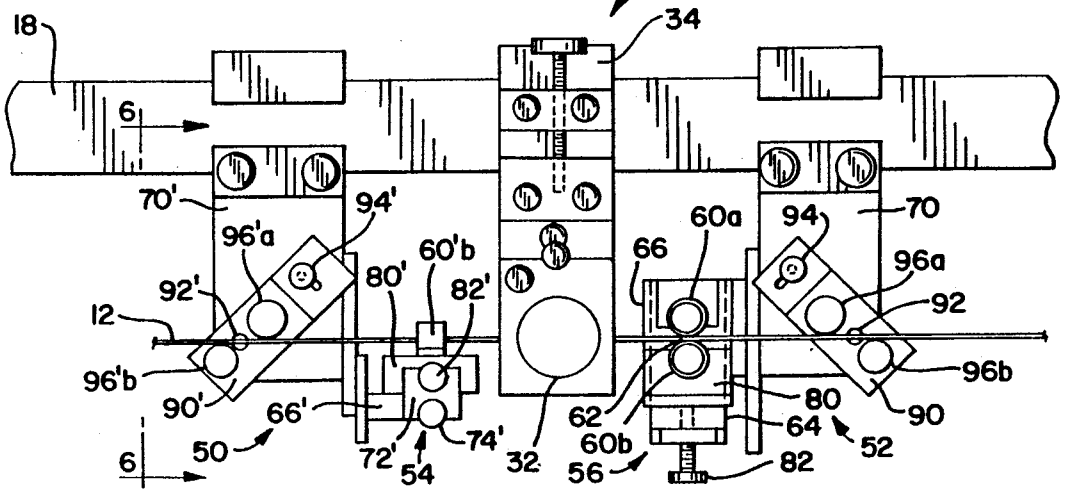
FIG. 2 is a front elevational view, on an enlarged scale, of the wire guide means employed in the system of FIG. 1.

Referring now to the drawings, and in particular to FIG. 1, a system for printing indicia on a substantially continuous length elongated member is indicated generally at 10. The system 10, which may alternatively be termed a wire handling and printing system, is operative to apply indicia such as multiple character alphanumeric identifying data or codes at generally uniformly spaced positions along the length of a continuous elongated member such as a single insulated electrical conductor wire 12 or a multiple strand conductor wire, both of which have generally cylindrical 3-dimensional outer peripheral surfaces on which identifying indicia is to be applied. During the marking or printing process, and assuming the elongated member 12 comprises an insulated electrical conductor wire, the wire is withdrawn from a suitably supported horizontal axis supply spool or reel 14 and passed through a conventional wire straightener, indicated generally at 16, having a series of adjustable horizontally and vertically opposed rollers **16*a* and 16*b*, respectively. In the illustrated embodiment, the wire straightener assembly 16 is supported from a horizontal generally rectangular support bar 18 having one end supported by an upstanding support leg 20 and having its opposite end supported by a floor-mounted wire cutter/stripper, indicated schematically at 22. The wire cutter/stripper 22 is of conventional design such as commercially available from Artos, Milwaukee, Wisc., and has a pair of wire feed rollers 26*a* and 26*b* which define a nip therebetween to receive the elongated insulated wire 12 and are suitably rotatably driven in a controlled manner to effect withdrawal of the wire from the supply spool 14 and pull the wire in a generally horizontal direction through the wire straightener assembly 16** which is operative to substantially eliminate any kinks in the wire and minimize curling.

As the wire 12 leaves the wire straightener assembly 16, it is passed through a printing station 30 which includes non-contact printing means in the form of an ink jet type print head 32 operative to project droplets of ink onto the peripheral surface of the passing wire in a predetermined array to create multiple character alphanumeric codes or other identifying indicia on the outer surface of the passing wire. The ink jet print head 32 is of the type commercially available from A. B. Dick Co., Chicago, Ill., and is mounted on a support bracket 34 so that the print head is operative to project ink droplets in a generally horizontal plane containing the axis of the advancing wire 18 with the droplets moving perpendicular to the longitudinal axis of the wire. To this end, the support bracket 34 is of the type enabling fine adjustment of the position of the ink jet discharge nozzle orifice relative to the wire 12. The ink jet print head 32 is operatively associated with an ink jet printer control 38 which in turn may be controlled through a programmable data input terminal 40 of known design. Encoder means in the form of a dual pulse shaft encoder of known design is cooperative with the wire 12 and has a rotatable encoder roller and a rotatable pressure roller, indicated schematically at 42 and 44, respectively, in FIG. 1. The encoder roller 42 is rotated by the moving wire 12 and is coupled to the ink jet printer control 38 to precisely control placement of alphanumeric indicia on the wire 12 and also prevents printing of indicia on the wire while it is stationary, as is known.

In accordance with the present invention, guide means in the form of a first guide means 50 and a second guide means 52 are cooperative with the elongated wire 12 on the upstream and downstream sides, respectively, of the printing station 30 for maintaining the wire in a constant rotational orientation without vertical or back and forth movement as it moves longitudinally past the print head 32 in a manner to prevent smearing or smudging of the indicia printed on the wire, while assuring longitudinal alignment of the printed alpha-numeric characters applied to the wire. Referring FIGS. 2–6, in a first embodiment the first and second guide means 50 and 52 are somewhat similar in that each includes roller means, indicated generally at 54 and 56, respectively. Each roller means comprises a pair of rollers which define a nip therebetween to receive the continuous wire member 12 and maintain the wire in a substantially constant oriention without vertically or rearward longitudinal movement or twisting of the wire as it passes the ink jet print head 32. The guide roller means 54 and 56 are substantially similar in construction and differ in that the roller pair of the roller means 54 are rotatable about substantially vertical axes while the roller pair of the roller means 56 are rotatable about substantially horizontal axes.

Figure 3:
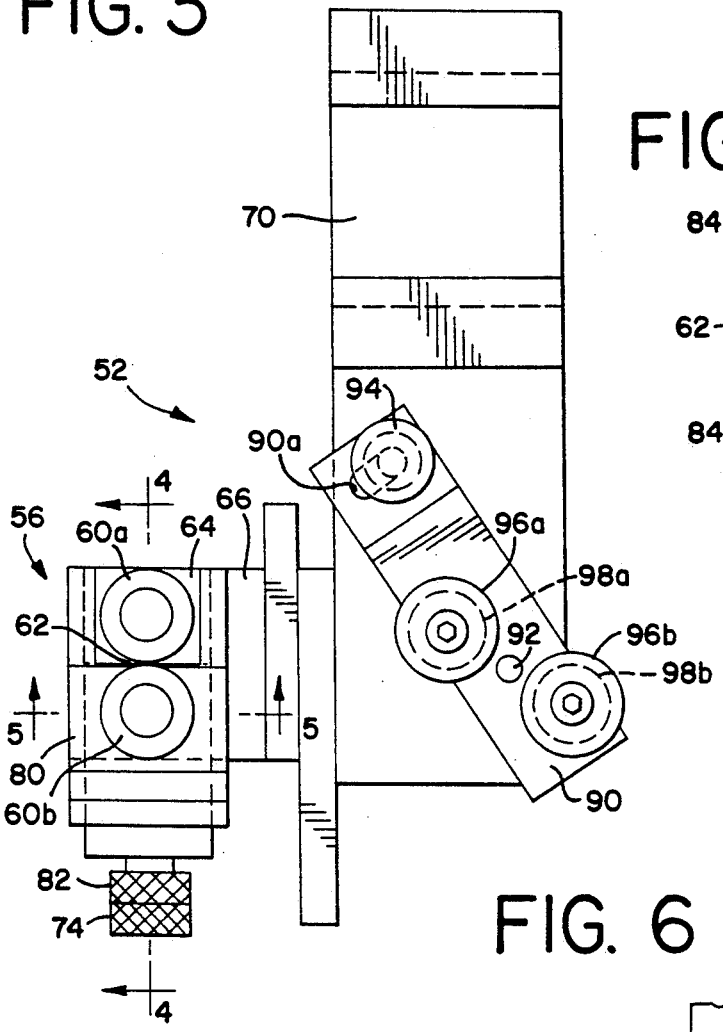
FIG. 3 is a front elevational view, on an enlarged scale, of the wire guide means disposed downstream from the printing station.
Figure 4:
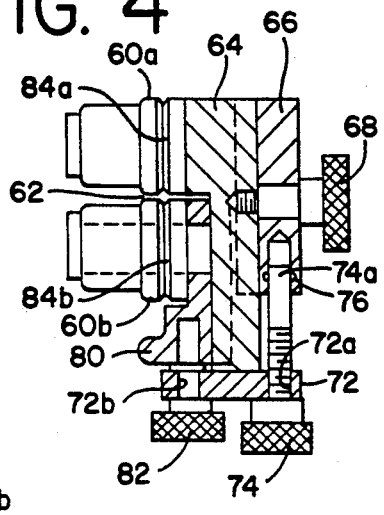
FIG. 4 is a longitudinal sectional view taken substantially along line 4—4 of FIG. 3.
Figure 5:
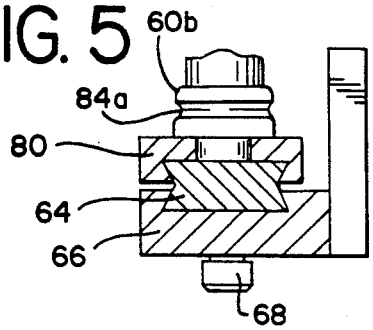
FIG. 5 is a transverse sectional view taken substantially along line 5—5 of FIG. 3.

As illustrated more clearly in FIGS. 3–5, the guide roller means 56 includes a pair of substantially identical guide rollers 60*a* and 60*b* which define a nip 62 therebetween through which the continuous wire member 12 passes. The guide roller 60*a* is rotatably supported on a support block 64 which is adjustably mounted on a mounting plate 66 through a releasable locking screw 68 having a shank which extends through an elongated opening in the mounting plate and is threadly connected to the support block 64 so as to enable vertical adjustment of the roller 60*a* relative to the mounting plate 66. The mounting plate 66 is in turn fixed to a support bracket 70 which is itself supported by and movable along the support bar 18 on the downstream side of the printing station 30 to enable adjustment of the distance between the ink jet print head 32 and the guide rollers 60*a,b*.

A plate member 72 is fixed to a lower transverse end of the support block 64 and has a tapped bore 72*a* which receives the threaded shank of an adjustment screw 74. An end 74*a* of the adjustment screw 74 is retained within a bore in the base or mounting plate 66, as by a suitable retaining ring 76, so that rotation of the adjustment screw 74 moves the plate member 72 and support block 64 vertically relative to the base plate 66, thus adjusting the vertical height of the guide roller 60*a* relative to the support bracket 70.

As illustrated in FIG. 5, the support block 64 has generally V-shaped grooves formed in its longitudinal laterally opposite edges which facilitate slidable retention within the base block 66 and also enable slidable mounting of an upper roller support block 80 which rotatably supports the guide roller 60*b*. A suitable adjustment screw 82 is rotatable within a suitable cylindrical bore 72*b* in the plate member 72 and has a threaded shank received within a threaded bore in the support block 80 such that selective rotation of the adjustment screw 88 effects vertical adjustment of the guide roller 60*b* relative to the guide roller 60*a* for accommodating different size wire members 12.

Referring to FIG. 4, each of the guide rollers 60*a* and 60*b* has an annular groove formed about its outer periphery such as indicated at 84*a* and 84*b*, respectively. The annular grooves 84*a* and 84*b* in the wire guide rollers 60*a* and 60*b* have V-shaped cross-section with the included angle of the V-groove in the guide rollers being 140 degrees for wire sizes of A.W.G. 16 and larger, and having included V-angles of approximately 170 degrees for wire sizes of A.W.G. 18 and smaller. In this manner, the guide rollers 60*a* and 60*b* may be selected to receive and guide continuous length wire members of various sizes through the nip 62 after printing alpha-numeric indicia on the outer surface of the wire member without contact and smearing of the printed indicia as it leaves the jet print head 32.

The roller means 54 of the first guide means 50 is substantially identical to the aforedescribed roller means 56 and has its various components identified with similar but primed reference numerals. The roller means 54 thus has a pair of guide roller 60'*a* and 60'*b* which are supported for rotation about vertical axes by a base block or mounting plates 66' which is affixed to a support bracket 70' adjustable along the length of the support bar 18 on the upstream side of the printing station 30. In similar fashion to the downstream wire guide rollers 60*a* and 60*b*, the wire guide rollers 60'*a* and 60'*b* preferably have annular V-shaped grooves formed about their periphery which cooperate to receive and guide the continuous wire member 12 on the upstream side of the ink jet print head 32 so that the wire traverses a substantially horizontal path precisely positioned relative to the ink jet droplet discharge nozzle (not shown) of the ink jet print head.

In accordance with one feature of the system 10 for printing indicia on the continuous length insulated conductor wire 12, at least one of the guide rollers 60*a* and 60*b* of the roller means 6, and preferably each of the wire guide rollers 60*a,b* and 60'*a,b*, is mounted for rotation about its rotational axis through unidirectional means so as to prevent the guide rollers from rotating in a rotational direction which would allow rearward longitudinal movement of the elongated wire member as it passes the printing station 30 from the upstream side of the printing station. Preferably, each of the guide rollers 60*a,b* and 60'*a,b* has unidirectional means in the form of a one-way bearing which allows forward longitudinal movement of the conductor wire 12 but prevents rearward longitudinal movement of the conductor wire. Such one-way bearings are commercially available from Torrington Company, Torrington, Conn., as roller clutch and bearing assemblies.

Figure 6:
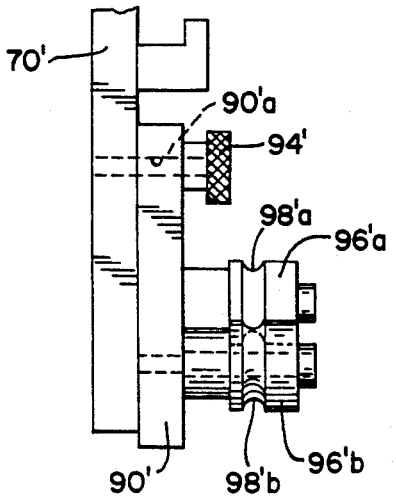
FIG. 6 is a fragmentary side elevational view taken substantially along line 6—6 of FIG. 2.

In accordance with another feature of the wire marking system 10 illustrated in FIGS. 1–6, each of the first and second guide means 50 and 52 has a set of pivoting wire guides which cooperate with the corresponding pairs of guide rollers 60*a,b* and 60'*a,b* to substantially prevent movement of the continuous length wire member in a generally vertical plane as it passes between the sets of guide rollers. Referring to FIGS. 3 and 6, taken in conjunction with FIG. 1, each of the support brackets 70 and 70' supports a generally rectangular pivot bar 90 for pivotal movement in a generally vertical plane about a horizontal pivot axis 92. Each pivot bar 90 has an elongated slot 90*a* adjacent the end thereof spaced from its pivot axis 92 and which receives a locking thumb screw 94 having threaded engagement with the associated support bracket 70 to enable limited pivotal movement of the pivot bar and locking in a desired position. Each of the pivot bars 90 carries a pair of rollers 96*a* and 96*b* which, as illustrated in FIG. 6, have annular grooves 98*a* and 98*b*, respectively, formed about their annular peripheries. The grooves 98*a,b* have generally semicircular transverse cross-sectional configurations with the radius of each annular groove being sufficiently greater than the radius of the elongated wire member 12 so as to effect line contact between the annular grooves and the wire member in a vertical plane containing the longitudinal axis of the wire. The rollers 96*a,b* on each of the pivot bars 90 are positioned such that a vertical plane containing the minor diameters of each pair of the grooves 98*a,b* is substantially coplanar with a vertical plane containing the bases of the V-grooves in the corresponding wire guide rollers 60*a,b* and 60'*a,b*. With an elongated wire member 12 passing through the nips defined between the pairs of guide rollers 60*a,b* and 60'*a,b* and passing between the corresponding pairs of guide rollers 96*a,b* on the wire guides, each pivot bar 90 may be adjusted to apply a desired longitudinal tension on the elongated wire member as it passes the ink jet printer station. This further assures proper positioning of the elongated wire member 12 as it passes through the print station 30 past ink jet print head 32.

FIGS. 7–10 illustrate an alternative embodiment of a wire handling system, indicating generally at 100, for printing alpha-numeric indicia on an elongated member, such as the insulated wire 12. The wire handling system 00 is a free-standing modular wire handling system that includes a printing station having non-contact printing means and can be employed with substantially any wire processing machinery in which it is desired to apply alpha-numeric indicia to the outer surface of a continuous length elongated wire member.

The wire handling system 100 includes a generally rectangular support plate 102 adapted for releasable mounting on the upper end of a generally vertical support rod or shaft 104 the lower end of which is preferably fixed on a suitable tripod type stand (not shown). The support plate 102 preferably has a mounting block 106 mounted on the rearward side thereof which has a cylindrical bore 106*a* of a diameter enabling sliding receipt of the support shaft 104. A locking arm 108 is supported by the guide block 106 and is cooperable with the support shaft 104 to releasably lock the support plate 102 in a selected vertical and rotational position on the support shaft.

The support plate 102 supports non-contact printing means in the form of the aforedescribed ink jet print head 32 such that the longitudinal axis of the print head is normal to the planar support plate. The ink jet print head 32 is supported on a vertically adjustable slide block 112 which is retained within a generally vertical track formed on the forward surface of a track member 114 which in turn is fixed to the support plate 102 in spaced relation therefrom. An adjustment screw support block 116 is fixed on the track member 114 and has a vertical threaded bore therethrough which receives an adjustment screw 118 the upper end of which is rotatably retained within the support block 112 to facilitate vertical adjustment of the ink jet print head 32 relative to the support plate 102.

The wire handling mechanism 100 can be employed with a conventional wire cutter/stripper, such as the aforedescribed cutter/stripper 22, which includes wire feed rollers to draw an elongated member, such as the continuous length wire 12, through the wire handling mechanism 100 adjacent the discharge nozzle of the ink jet print head 32. The print head 32 is operable to selectively apply alpha-numeric indicia to the outer surface of the elongated wire member; as aforedescribed. To guide the elongated wire member 12 in proper relation past the discharge nozzle of the ink jet print head, the wire handling mechanism 100 includes a pair of cylindrical guide rollers 122*a* and 122*b* which define a nip 124 therebetween to receive the wire member on the downstream side of the print head 32. The lower guide roller 122*b* is rotatably mounted on a support shaft 126 which is fixedly mounted on the support plate 102 such that the rotational axis of the guide roller 122*b* lies in a substantially horizontal plane normal to the support plate 102 but is inclined in a downward direction from a vertical plane normal to the plate 102. In the illustrated embodiment, the rotational axis of roller 122*b* is inclined in the downstream direction so as to form an included angle of incline of approximately 2°–5° with a vertical plane normal to support plate 102.

The upper wire guide roller 122*a* is rotatably carried on a support shaft 128 which is fixed to a support arm 130 mounted radially on a pivot shaft 132. The pivot shaft 132 extends through and is rotatably supported by the support plate 102 so that the axis of the pivot shaft is perpendicular to plate 102. The end of the pivot shaft 132 opposite the arm 130 has an actuating arm 134 fixed radially thereon the outer end of which is connected to one end of a coil tension spring 136 having its opposite end connected to the mounting plate 102 through a suitable anchor connector 138. The tension spring 136 biases the outer periphery of guide roller 122*a* against the outer peripheral surface of the guide roller 122*b*. The rotational axis of the upper roller 122*a*, as defined by the support shaft 128, is also inclined in a downstream direction from a vertical plane normal to the support plate 102 at an angle of approximately 2°–5°. In this manner, with the outer peripheral surfaces of the rollers 22*a,b* engaging each other along a line of contact, their rotational axes are parallel and lie in a common Vertical plane inclined at an angle of 2–5 degrees from a vertical plane normal to the support plate 102. Such angle of incline is indicated at angle alpha in FIG. 8. Stated alternatively, the rotational axes of the wire guide rollers 122*a* and *b* lie in a generally vertical plane which forms an included angle of approximately 85–87 degrees with the mounting plate 102.

Figures 7, 8, 9, 10:
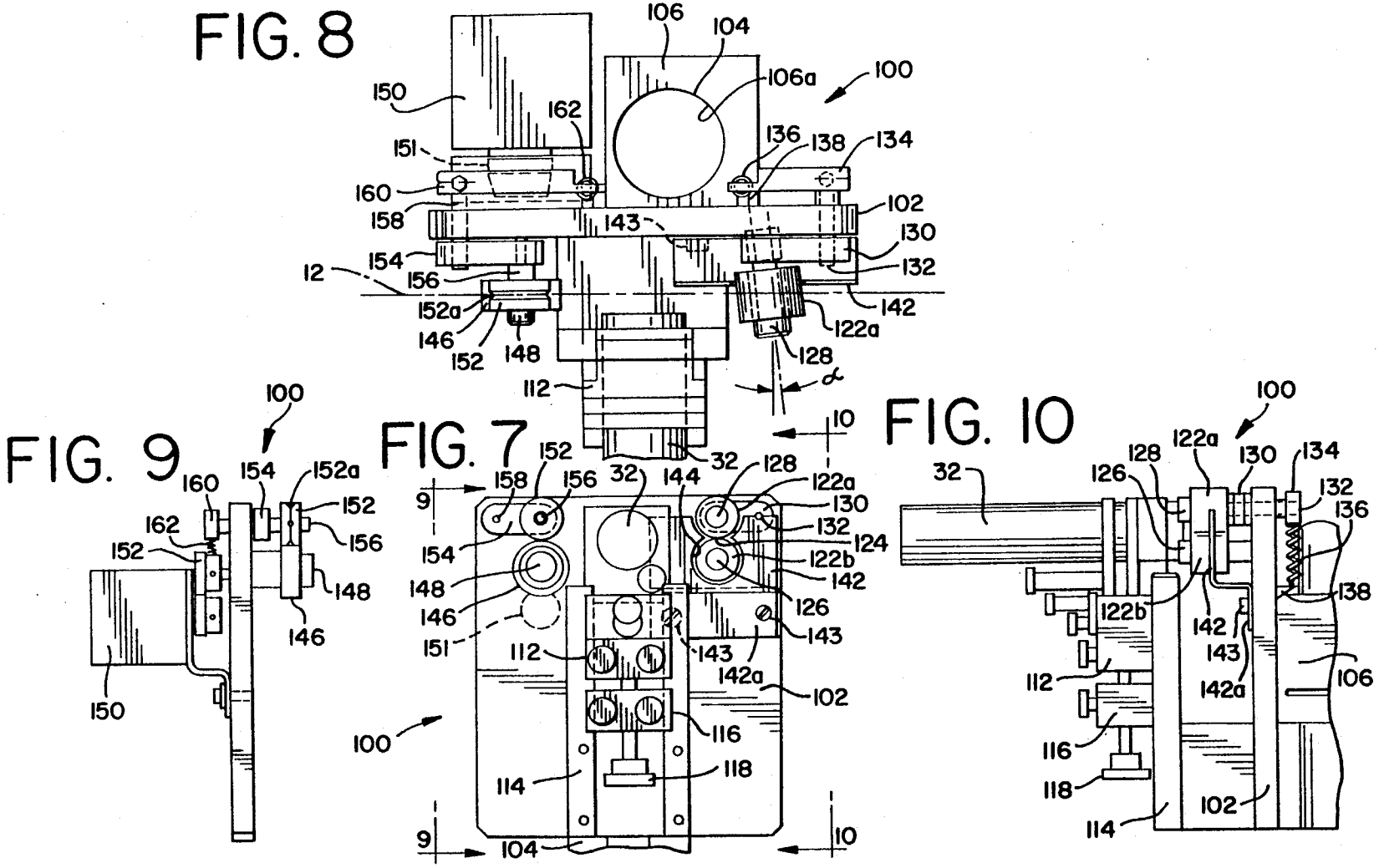
FIG. 7 is a front elevational view of an alternative embodiment of a wire handling and guide mechanism for use with a non-contact printer in accordance with the invention.
FIG. 8 is a plan view of the wire handling mechanism of FIG. 7.
FIG. 9 is a side elevational view taken substantially along the line 9—9 of FIG. 7.
FIG. 10 is a side elevational view taken substantially along line 10—10 of FIG. 7.

By inclining the axes of rotation of the cylindrical guide rollers 122*a* and 122*b* as aforedescribed, passing the elongated wire member 12 through the nip 124 on the downstream side of the ink jet print head 32 causes the elongated member to be biased or urged by the inclined cylindrical guide rollers 122*a*,b against a backing or reference plate 142, as illustrted in FIG. 10, the reference plate 142 is generally S-shaped in edge elevation and has a lower portion 142*a* mounted on the front surface of the support plate 102, as by screws 143, such that the plate 142 extends in generally parallel outwardly spaced relation to support plate 102. The plate 142 lies in a plane intersecting the rotational axes of the rollers 122*a,b* at approximately their midlengths, and has a suitable opening 144 therein to receive the lower guide roller 122*b* therethrough and at least a portion of the upper guide roller 122*a*. In this manner, the reference plate 142 lies in a plane substantially parallel to the direction of movement of the elongated member 12 and substantially transverse to the longitudinal axis of the ink jet print head 32. The guide rollers 122*a* and 122*b* contact the elongated wire member 12 tangentially at substantially diametrically opposed lines of contact and urge the elongated member against the reference plate 142 so that the elongated member does not rotate about its longitudinal axis and the printed indicia is not contacted by the guide rollers which could lead to smearing or smudging of the printed alpha-numeric indicia. It will be appreciated that with the rollers 122*a* and 122*b* inclined in a downstream direction relative a vertical plane normal to the reference plate 142, and with the rollers 122*a,b* rotating in opposite directions as the wire member 12 passes through the nip 124, each of the rollers imparts a force component to the wire member which acts in a direction generally tangent to the respective inclined roller 122*a* or 122*b* at its point of contact with the wire member. These force components are of substantially equal magnitude and urge the wire member against the reference plate 142 while offsetting each other so as to create a substantially zero net rotational moment on the wire member. In this manner, the rollers 122*a,b* cooperate with the reference plate 142 to prevent rotation of the wire member about its longitudinal axis as it passes through the wire handling system 100.

Preferably, a shaft encoder roller 146 similar to the aforedescribed shaft encoder roller 42 is mounted on a suitable support shaft 148 which extends through the support plate 102 and is coupled to a suitable encoder 150 through a gear reducer or other suitable drive coupling 151. An upper pressure roller 152 is rotatably mounted on a support arm 154 through a support shaft 156. The support arm 154 is fixed radially on a transverse pivot pin 158 which extends through the support plate 102 and has an actuating arm 160 fixed to the inner end thereof. The free end of the actuating arm 160 is connected through a coil tension spring 162 to a suitable anchor fixed on the back of the mounting plate 102 so as to bias the pressure roller 152 against the cylindrical encoder roller 148. preferably an annular groove 152*a* is formed in the periphery of the pressure roller 152 to lie substantially in a plane parallel to the outer surface of the reference plate 142 and spaced outwardly therefrom a distance equal to the radius of the wire member 12. The pressure roller 152 thus cooperates with the guide rollers 122*a* and 122*b* in guiding the elongated wire member 12 generally parallel to the outer surface of the support plate 102 in predetermined relation to the discharge nozzle of the ink jet print head 32.

In accordance with a feature of the wire handling mechanism 100, each of the cylindrical guide rollers 122*a* and 122*b* has unidirectional means in the form of a one-way bearing interposed between the guide roller and its respective support shaft 126 or 128 so as to allow free rotation of the guide rollers in a direction allowing longitudinal forward movement of the elongated wire member 12 while preventing reverse rotation as would allow rearward longitudinal movement of the elongated wire member. The unidirectional means employed with the rollers 122*a,b* may similarly comprise conventional roller clutch and bearing assemblies such as commercially available from Torrington Co.

While preferred embodiments of wire handling systems in accordance with the present invention for guiding continuous length elongated generally cylindrical members past non-contact ink printing heads without smudging indicia printed on the members have been illustrated and described, it will be understood that changes and modifications may be made therein without departing from the invention in its broader aspects. Various features of the invention are defined in the following claims.

What is claimed is:

1. In a system for printing indicia on a substantially continuous length elongated member having a three-dimensional external surface, said system including means for advancing the member along its longitudinal axis past a printing station having non-contact printing means selectively operable to apply indicia to the external surface of the member; the combination therewith comprising guide means cooperative with the elongated member to guide it past the printing means, said guide means including a first pair of guide rollers defining a nip cooperative with the elongated member downstream from the printing means, means cooperative with said first pair of guide rollers for substantially preventing rotation of the elongated member about its longitudinal axis without contacting indicia applied to the member by said printing means, a second pair of guide rollers defining a nip cooperative with said elongated member upstream from the printing means and being cooperative with the first pair of rollers to guide the elongated member along a straight path past the printing means, at least one roller of each of said first and second pairs of rollers having unidirectional means enabling free rotation of the roller in a direction to allow advance of the elongated member while preventing rearward longitudinal movement of the elongated member.

2. A system as defined in claim 1 wherein said non-contact printing means comprises at least one ink jet print head operative to project ink droplets onto the external surface of the elongated member in a predetermined array as the elongated member moves longitudinally past the printing station.

3. A system as defined in claim 1 wherein each roller of said first and second pairs of rollers has unidirectional means preventing rotation of the roller in a direction which would allow rearward longitudinal movement of the elongated member.

4. A system as defined in claim 1 wherein said guide rollers have annual grooves formed therein, said grooves being generally V-shaped in the transverse cross-section and having base angles in the range of approximately 140–170 degrees.

5. In a system for printing indicia on a substantially continuous length elongated member having a three-dimensional external surface, said system including means for advancing the member along its longitudinal axis past a printing station having non-contact printing means selectively operable to apply indicia to the external surface of the member; the combination therewith comprising guide means cooperative with the elongated member to guide it past the printing means, said guide means including a first pair of guide rollers defining a nip cooperative with the elongated member downstream from the printing means, said first pair of guide rollers being operative to substantially prevent rotation of the elongated member about its longitudinal axis without contacting indicia applied to the member by said printing means, a second pair of guide rollers defining a nip cooperative with said elongated member upstream from the printing means, each roller of said first and second pairs of rollers having unidirectional means preventing rotation of the roller in a direction which would allow rearward longitudinal movement of the elongated member, and a pair of pivot rollers operatively associated with each of said first and second pairs of guide rollers to assist in stabilizing the elongated member as it passes the printing means.

6. In a system for printing indicia on a substantially continuous length elongated member having a three-dimensional external surface, said system including means for advancing the member along its longitudinal axis past a printing station having non-contact printing means selectively operable to apply indicia to the external surface of the member; the combination therewith comprising guide means cooperative with the elongated member to guide it past the printing means, said guide means including a first pair of guide rollers defining a nip cooperative with the elongated member downstream from the printing means, said first pair of guide rollers being operative to substantially prevent rotation of the elongated member about its longitudinal axis without contacting indicia applied to the member by said printing means, a second pair of guide rollers defining a nip cooperative with said elongated member upstream from the printing means, at least one roller of each of said first and second pairs of rollers having unidirectional means preventing rearward longitudinal movement of the elongated member, and wire guide means supported adjacent each of said pairs of guide rollers, said wire guide means each comprising a pivot bar and a pair of pivot rollers rotatably supported on said pivot bar in spaced apart relation to receive the elongated member therebetween in rolling contact with the pivot rollers, said pivot rollers cooperating with said pairs of guide rollers to substantially prevent vertical movement of the elongated member as it passes between said pairs of guide rollers.

7. The system as defined in claim 6 wherein said pivot bars are each adjustable about a horizontal pivot axis to enable adjustment of the vertical relation of the pivot rollers to the guide rollers.

8. The system as defined in claim 7 wherein said guide and pivot rollers have annular grooves lying substantially in a common vertical plane and operative to receive and guide the elongated member as it passes between said pairs of rollers.

9. The system as defined in claim 8 wherein said annular grooves are configured to contact the elongated member along lines of contact which do not interfere with indicia applied to the elongated member by the printing means as the member passes downstream from the printing means.

10. In a system for printing indicia on a substantially continuous length elongated member having a three-dimensional external surface, said system including means for advancing the member along its longitudinal axis in a path past a printing station having non-contact printing means selectively operable to apply indicia to the external surface of the member; the combination therewith comprising guide means cooperative with the elongated member to guide it past the printing means, said guide means including a pair of cylindrical guide rollers defining a nip therebetween cooperative with the elongated member downstream from the printing means, and a reference plate supported closely adjacent the path traversed by the elongated member, said cylindrical rollers being supported for rotation about parallel axes inclined to the direction of movement of the elongated member so as to bias the elongated member against said reference plate and substantially prevent rotation of the elongated member about its longitudinal axis without contacting indicia applied to the member by said printing means.

11. A system as defined in claim 10 wherein said reference plate lies substantially in a vertical plane disposed parallel to the path traversed by said elongated member downstream from said printing means, said cylindrical rollers passing through said reference plate and being inclined thereto so as to bias the elongated member against the reference plate as the member passes through the nip between the cylindrical rollers.

12. A free-standing wire marking apparatus for applying indicia along the length of an elongated generally cylindrical member, said apparatus comprising, in combination, an upstanding support stand, mounting plate means supported by said support stand, non-contact printing means supported by said plate means and operative to project ink droplets along a predetermined path, first guide means supported by said mounting plate on an upstream side of said printing means, and second guide means supported by said mounting plate on a downstream side of said printing means, said first and second guide means being cooperative with an elongated generally cylindrical member to guide the member longitudinally past said printing means so that said member intersects said predetermined path in transverse relation thereto, said second guide means including a reference plate supported by said mounting plate means, and a pair of cylindrical guide rollers defining a nip operative to receive the elongated member therethrough and being rotatable about axes inclined to the longitudinal axis of the elongated member so as to bias the elongated member against said reference plate as it passes through said nip, said cylindrical rollers and reference plate cooperating to substantially prevent rotation of the elongated member about its longitudinal axis while engaging the elongated member on substantially diametrically opposed points of contact without contacting indicia applied by said printing means.

13. A wire marking apparatus as defined in claim 12 wherein said printing means comprises an ink jet print head supported to project ink droplets along a generally horizontal axis, said cylindrical rollers being supported for rotation about axes lying in plates substantially parallel to a plane containing the axis of the elongated member and the axis traversed by said ink droplets, said reference plate defining a planar reference surface parallel to the longitudinal axis of the elongated member as it passes downstream from said print head, the rotational axes of said cylindrical rollers being inclined relative to said reference surface so as to urge the elongated member against said reference surface as it passes through said nip.

14. A wire marking apparatus as defined in claim 13 wherein said cylindrical rollers have their rotational axes inclined in a downstream direction from a vertical plane normal to said reference surface.

15. A wire marking apparatus as defined in claim 14 wherein said rotational axes of said cylindrical rollers each subtends an included angle of approximately 83–87 degrees with the plane of said reference surface.

16. A wire marking apparatus as defined in claim 12 including means supporting said cylindrical rollers for relative movement therebetween to accommodate different diameter elongated members in the nip defined between said rollers.

17. A wire marking apparatus as defined in claim 16 including means biasing said cylindrical rollers toward each other.

18. A wire marking apparatus as defined in claim 16 wherein said rollers support means includes a pivot arm supported by said mounting plate means, one of said cylindrical rollers being carried by said pivot arm, and including means biasing said pivot arm toward a position biasing said one cylindrical roller toward the other of said cylindrical rollers.

19. A wire marking apparatus as defined in claim 12 wherein said first guide means includes a pair of guide rollers defining a nip to receive the elongated member therethrough.

20. A wire marking apparatus as defined in claim 19 wherein at least one of the guide rollers of said first guide means has an annular peripheral groove therein to receive the elongated member as it passes between said guide rollers.

21. A wire marking apparatus as defined in claim 19 wherein one of the guide rollers of said first guide means comprises an encoder roller.

22. A wire marking apparatus as defined in claim 21 including means biasing the other of said pair of guide rollers of said first guide means against said encoder roller.

23. A method for guiding a substantially cylindrical elongated member longitudinally past a non-contact printing head operative to apply indicia to the external cylindrical surface of the member as it moves past the printing head, said method comprising the steps of:

(a) passing the elongated member longitudinally through first guide means upstream from the printing head, (b) passing the elongated member longitudinally through second guide means downstream from the printing head so that the elongated member transverses a straight path between the first and second guide means, said second guide means including a pair of guide rollers defining a nip therebetween operative to receive the elongated member with the guide rollers engaging the member along diametrically opposed lines of contact, and (c) providing a reference surface and urging the elongated member against said reference surface as it passes through said nip so as to maintain said member in said straight path and substantially prevent rotation of the elongated member about its longitudinal axis as it passes through said nip.

24. The method of claim 23 wherein said guide rollers are substantially cylindrical and rotatable about parallel axes inclined downstream relative to a vertical plane normal to said reference surface, said step of urging the elongated member against said reference surface including passing the member through said nip so as to cause said guide rollers to rotate in a direction urging the elongated member against the reference surface as it passes through said nip.

25. The method as defined in claim 24 wherein the step of urging the elongated member against said reference surface includes inclining the rotational axes of said cylindrical guide rollers in a downstream direction to subtend included angles of approximately 85°–88° with the plane of the reference surface.

26. The method as defined in claim 25 including the step of preventing longitudinal movement of the elongated member in a direction reverse to said predetermined path.

27. The method of claim 23 including the step of biasing said cylindrical rollers toward each other with said elongated member passing through said nip.

* * * * *